US007607920B1

(12) United States Patent
Chen

(10) Patent No.: US 7,607,920 B1
(45) Date of Patent: Oct. 27, 2009

(54) CONNECTING DEVICE FOR INTERCONNECTING ELECTRONIC DEVICES

(75) Inventor: Chao-Jen Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/248,899

(22) Filed: Oct. 10, 2008

(30) Foreign Application Priority Data

Jun. 19, 2008 (CN) ..... 200810302218.7

(51) Int. Cl.
*H01R 13/60* (2006.01)

(52) U.S. Cl. ..... 439/39

(58) Field of Classification Search ..... 439/38, 439/39, 40
See application file for complete search history.

(56) References Cited

U.S. PATENT DOCUMENTS 3,363,214 A * 1/1968 Wright ..... 439/39
5,401,175 A * 3/1995 Guimond et al. ..... 439/38
7,264,479 B1 * 9/2007 Lee ..... 439/39
7,329,128 B1 * 2/2008 Awad ..... 439/38
7,354,315 B2 * 4/2008 Goetz et al. ..... 439/669
7,500,882 B2 * 3/2009 Goetz et al. ..... 439/669
2002/0169913 A1 11/2002 Heizer et al.
2007/0178771 A1 * 8/2007 Goetz et al. ..... 439/669
2008/0182455 A1 * 7/2008 Elku et al. ..... 439/617

* cited by examiner

*Primary Examiner*—James Harvey
(74) *Attorney, Agent, or Firm*—Frank R. Niranjan

(57) ABSTRACT

A connecting device includes an input portion, a first connecting member, a second connecting member, a wire and an output portion. The input portion is configured for electrically connecting to one of the two electronic devices. The first connecting member includes a first surface. The first surface forms a number of first electrical contacts electrically connected to the input portion. The output portion is configured for electrically connecting to the other electronic devices. The second connecting member includes a second surface, the second surface forms a number of second electrical contacts electrically connected to the output portion via the wire. The first and second connecting members magnetically attract each other so that the first and the second surface contact each other, and as a result, the first and second electrical contacts communicate with each other.

11 Claims, 2 Drawing Sheets

CONNECTING DEVICE FOR INTERCONNECTING ELECTRONIC DEVICES

BACKGROUND

1. Technical Field

The present disclosure relates to connecting devices and, particularly, to a connecting device for interconnecting two electronic devices.

2. Description of the Related Art

Current connectors for interconnecting electronic devices typically include two plugs and a cable electrically attached to the two plugs. The plugs may include an insulative body, electrical contacts and a metallic shell. The electrical contacts are mounted in the insulative body. The insulative body is received in the metallic shell. In use, the plugs are inserted into the receiving ports of the electronic devices, thereby interconnecting the electronic devices. The disadvantages of these connectors are: (1) after repeatedly plugging and unplugging the plugs, the plugs tend to deform, resulting in bad electrical connection; (2) misalignment between the plugs and the ports frequently occurs when the plugs are plugged into the ports, and as a result, the electrical contacts in the plugs become bent or damaged, making the plugs unusable.

What is needed, therefore, is a connecting device, which can overcome the above-described problems.

BRIEF DESCRIPTION OF THE DRAWINGS

Many aspects of the present connecting device should be better understood with reference to the accompanying drawings. The components in the drawings are not necessarily drawn to scale, the emphasis instead being placed upon clearly illustrating the principles of the present connecting device. Moreover, in the drawings, like reference numerals designate corresponding parts throughout the several views.

DETAILED DESCRIPTION

Embodiments of the present connecting device will now be described in detail with reference to the drawings.

Figure 1:
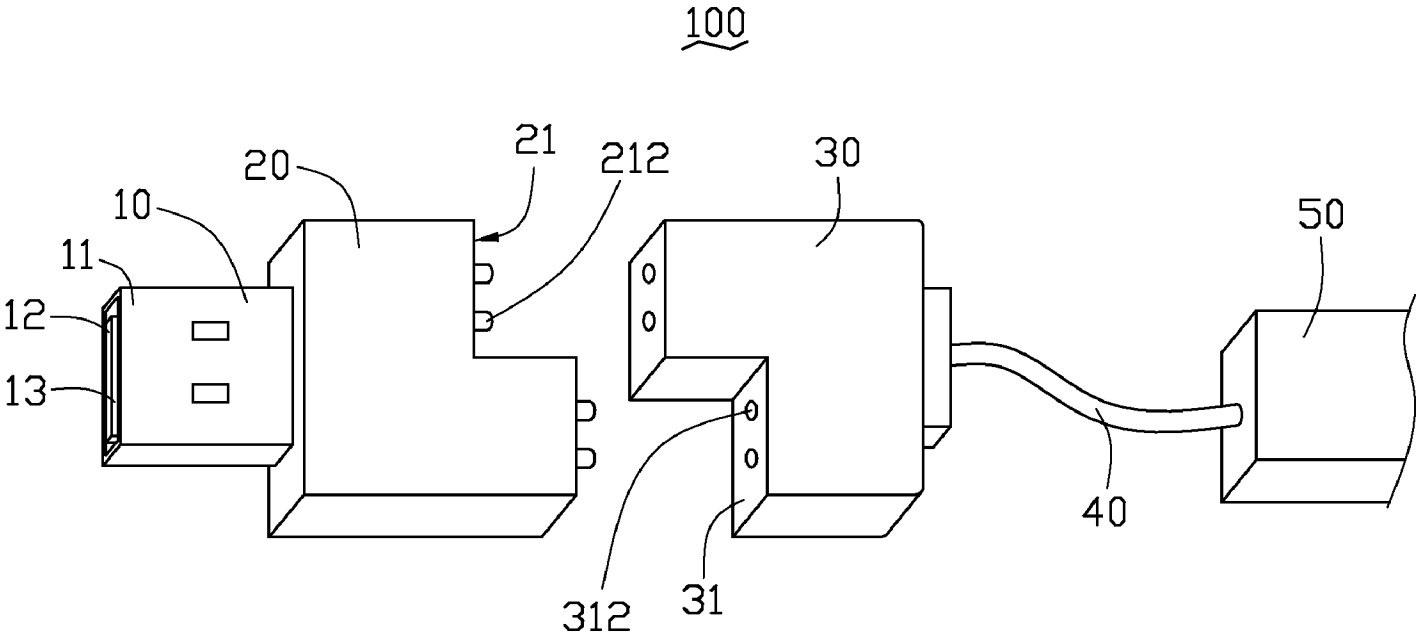
FIG. 1 is a schematic, exploded, isometric view of a connecting device, according to an exemplary embodiment.

Referring to FIG. 1, a connecting device 100 for interconnecting two electronic devices, according to an exemplary embodiment, includes an input portion 10, a first connecting member 20, a second connecting member 30, a wire 40, and an output portion 50. The input portion 10 is configured for electrically connecting to one of the two electronic devices. The first connecting member 20 includes a first surface 21. The first surface 21 forms a number of first electrical contacts 212 electrically connected to the input portion 10. The output portion 50 is configured for electrically connecting to the other of the two electronic devices. The second connecting member 30 includes a second surface 31, the second surface 31 forms a number of second electrical contacts 312 electrically connected to the output portion 50 via the wire 40. The first and second connecting members 20, 30 are capable of magnetically attracting each other so that the first and the second surface 21, 31 contact each other, and as a result, the first and second electrical contacts 212, 312 electrically communicate with each other.

The input portion 10 includes a type of electrical interface 12 compliant with the universal serial bus (USB) standard, an insulative body 13, and a metallic shell 11. The electrical interface 12 is mounted inside the insulative body 13. The insulative body 13 is received in the metallic shell 11. The metallic shell 11 is configured to provide an excellent physical protection and electromagnetic shielding for the electrical interface 12 and the insulative body 13.

In this embodiments, the first surface 21 is facing away from the input portion 10 and is step-like. The first connecting member 20 and the input portion 10 can be integrally formed. The electrical contacts 212 are electrically connected to the electrical interface 12 of the input portion 10 via an electrical circuit formed within the first connecting member 20 and the insulative body 13. The first connecting member 20 can be made of permanent magnetic materials, and the first electrical contacts 212 are male pins. The configuration of the first connecting member 20 and the input portion 10 is not limited by this embodiment. For example, in alternative embodiments, the first connecting member 20 is electrically connected to the input portion 10 via a wire.

The second connecting member 30 can be made of permanent magnetic materials too. The first and second surfaces 21, 31 have opposite polarities. Thereby, the first and the second connecting members 20, 30 can magnetically attract each other in a manner similar to the way the first and second surfaces 21, 31 contact each other. In this embodiment, the second electrical contacts 312 are female pins for receiving the first electrical contacts 212. The first and second electrical contacts 212, 312 electrically communicates with each other when the first and second surfaces 21, 31 are in contact. The second surface 31 of the connecting member 30 mates with the first surface 21 of the first connecting member 20. Thereby, the first and second surface 21, 31 are capable of engaging with each other to prevent the first and second connecting member 20, 30 from sliding relative to each other, and as a result the stability of communication between the first and second contracts 212, 312 are ensured.

The structure of the output portion 50 can be essentially similar to the input portion 10. The output portion 50 is electrically wired to the second connecting member 30 with the wire 40, thereby electrically connecting the second electrical contacts 312 and the output portion 50. In other alternative embodiments, the output portion 50 and the second connecting member 30 can be integrally formed. Accordingly, internal circuits are required to be formed within the second connecting member 30 and the output portion 50 to electrically connect the second electrical contacts 312 and the output portion 50.

The wire 40 is a data cable or power cable, depending on the type of the communication.

The connecting device 100 can interconnect or disconnect two electronic device without exerting a force to push or pull the input portion 10, and the output portion 50. Deformation of the plug can be avoided or at least reduced. Also, misalignment probability between the plugs of the connecting device and ports of the electronic device is limited.

Figure 2:
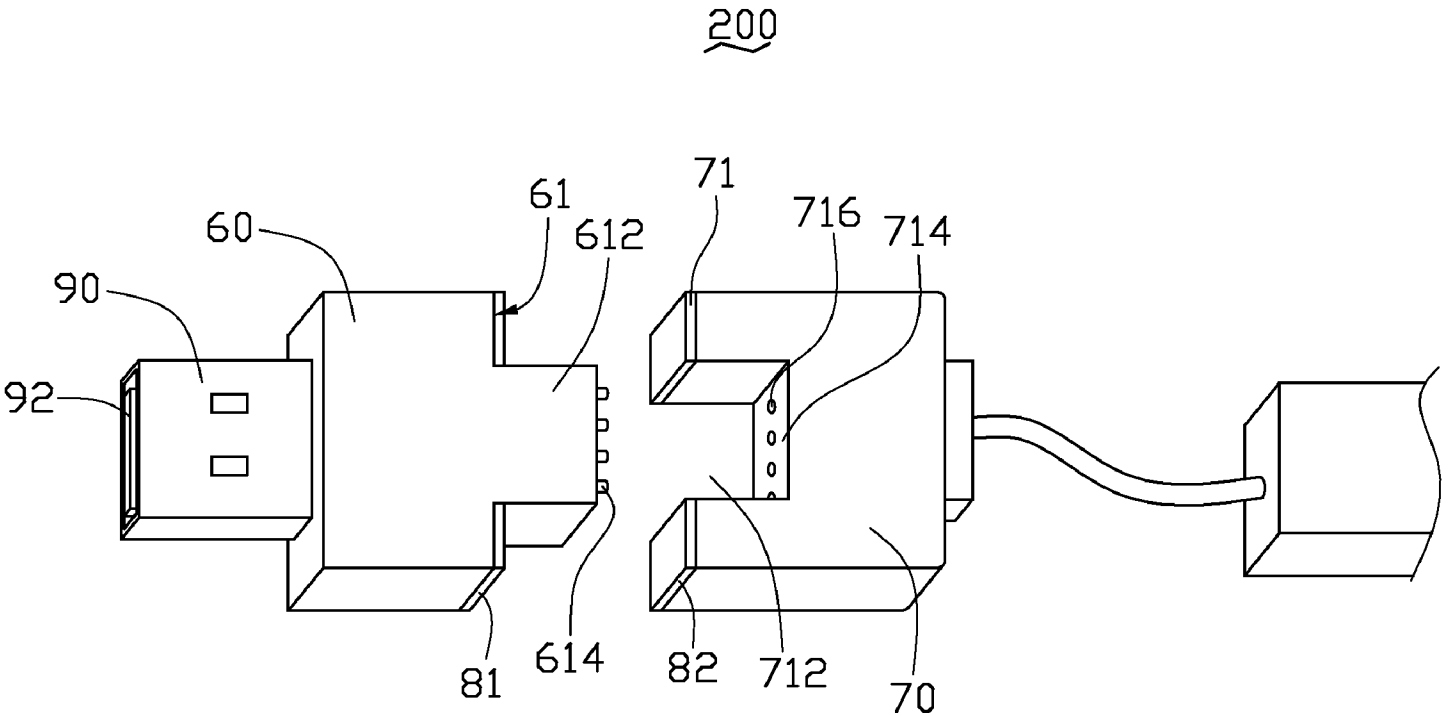
FIG. 2 is a schematic, exploded, isometric view of a connecting device, according to another exemplary embodiment.

Referring to FIG. 2, a connecting device 200 in accordance with a second exemplary embodiment is disclosed. The connecting device 200 is essentially similar to the connecting device 100 except the first connecting member 60 and the second connecting member 70. In this embodiment, the first surface 61 and the second surface 71 are both flat. A projection 612 protrudes upwardly from the center of the first surface 61. A number of male pins 614 are formed on the projection 612, and each of the male pins 614 is electrically connected to the electrical terminals 92 of the input portion 90.

An opening 712 is defined on the center of the second surface 71 of the second connecting member 70 corresponding to the location of the projection 612. The opening 712 has a bottom surface 714. A number of second electrical contacts 716 are defined on the bottom surface 714, the second electrical contacts 716 are female pins for receiving the first electrical contacts 614.

A first attracting member 81 is disposed on the first surface 61 and surrounds the projection 612. A second attracting member 82 is disposed on the second surface 71 and surrounds the opening 712. In this embodiment, the first connecting member 60 and the second connecting member 70 can be made of plastic cement. The first attracting member 81 and the second attracting member 82 can be made of permanent magnetic material, and the first and second attracting member 81, 82 are magnetized with opposite polarities.

In use, the first attracting member 81 and the second attracting member 82 are magnetically attached to each other, that is the first connecting member 60 and the second connecting member 70 magnetically attracted each other. So that the first electrical contacts 614 of the projection 612 are electrically contact to the second electrical contacts 716 and electrically communicate.

It will be understood that the above particular embodiments and methods are shown and described by way of illustration only. The principles and the features of the present invention may be employed in various and numerous embodiment thereof without departing from the scope of the invention as claimed. The above-described embodiments illustrate the scope of the invention but do not restrict the scope of the invention.

What is claimed is:

1. A connecting device for interconnecting two electronic devices, the connecting device comprising:

an input portion configured for electrically connecting to one of the electronic devices;

a first connecting member comprising a first surface, the first surface being flat and forming a plurality of first electrical contacts electrically connected to the input portion;

an output portion configured for electrically connecting to the other electronic device;

a second connecting member comprising a second surface, the second surface being flat and forming a second electrical contact electrically connected to the output portion; and a projection protruded upward from the center of the first surface the projection having a plurality of first electrical contacts formed thereon an opening being defined in the center of the second surface corresponding to the location of the projection, the opening having a bottom surface having a plurality of second electrical contacts defined thereon, the first and second connecting members being capable of magnetically attracting each other so that the first and the second surfaces contact and the first and second electrical contacts electrically communicate.

2. The connecting device as claimed in claim 1, wherein the input portion comprises a plug compliant with universal serial bus standard.

3. The connecting device as claimed in claim 1, wherein the input portion and the first connecting member are integrally formed.

4. The connecting device as claimed in claim 1, wherein the first electrical contacts are male pins, the second connecting contacts are female pins for receiving the first electrical contacts.

5. The connecting device as claimed in claim 1, wherein the output portion comprises a universal serial bus plug.

6. The connecting device as claimed in claim 1, wherein the connecting device further includes a first attracting member and the second attracting member, the first attracting member surrounds the projection, the second attracting member surrounds the opening.

7. The connecting device as claimed in claim 1, wherein the second connecting member is electrically wired to the output portion.

8. The connecting device as claimed in claim 1, wherein the first and the second connecting members are made of permanent magnetic material, the first and the second surfaces being magnetized with opposite polarities respectively.

9. The connecting device as claimed in claim 1, wherein the first and second surface mates with each other so as to be capable of engaging with each other to prevent the first and second connecting member from sliding against each other, thereby, the stability of communication between the first and second electrical contact is ensured.

10. The connecting device as claimed in claim 6, wherein the first and second attracting member are made of permanent magnetic material and magnetized with opposite polarities respectively.

11. The connecting device as claimed in claim 1, wherein the first connecting member and the second connecting member are made of plastic cement, except the first and the second surface which are made of permanent magnetic material, and the first and second surfaces are magnetized with opposite polarities.

* * * * *